US005971875A

United States Patent [19]

Hill

[11] Patent Number: 5,971,875

[45] Date of Patent: Oct. 26, 1999

[54] VANELESS ARROW SHAFT

[76] Inventor: Christopher Columbus Hill, P.O. Box 2214, Fernley, Nev. 89408

[21] Appl. No.: 09/052,087

[22] Filed: Mar. 31, 1998

[51] Int. Cl.[6] ..... F42B 6/02

[52] U.S. Cl. ..... 473/578

[58] Field of Search ..... 473/578, FOR 216; 124/62

[56] References Cited

U.S. PATENT DOCUMENTS

| | | | |
|---|---|---|---|
| 565,423 | 8/1896 | Beck et al. | 124/62 |
| 1,999,601 | 4/1935 | Tengel | 473/578 |
| 3,077,876 | 2/1963 | Richter | 473/578 X |
| 3,388,696 | 6/1968 | Hoverath et al. | 473/578 X |
| 3,735,748 | 5/1973 | Gaylord | 473/578 X |

*Primary Examiner*—William H. Grieb

[57] ABSTRACT

With the use of a smaller tube which fits inside the nock end of a arrow shaft and the smaller tube having molded in it spiraled grooves which acts upon dimples that are molded in the arrow shaft body and when the bowstring drives the smaller tube into the arrow shaft causeing the whole arrow shaft to spinn, the results of which allows the arrow shaft to oscillate less, fly stright without vanes, and faster with more peneration and will enter a close range target stright.

2 Claims, 1 Drawing Sheet

VANELESS ARROW SHAFT

CROSS REFERENCE TO RELATED APPLICATIONS not applicable

STATEMENT REGUARDING FEDERALLY SPONSORED RESEARCH OR DEVELOPMENT not applicable

BACKGROUND OF THE INVENTION

This invention relates to archery components, particularly a method of spinning the arrow shaft immediately upon being released from a bow.

Presently, most arrow shafts have various sizes and numbers of fletches or vanes of different designs. These vanes are for the purpose of better stablization to start the arrow shaft spinning as early as possiable. Spinning the arrow shaft is a must for stablization, for the following reasons;

First, when a standard arrow shaft is released from a bow, the arrow shaft bends around the bow staff. This is due to the arrow being forced to go from a dead standstill to full speed instantly. This bending back and forth, and the fact that the standard arrow shaft has vanes, account for great wind resistance and decreases arrow shaft speed.

Second; as the standard arrow shaft leaves the bow, it bends back and fourth until the wind hitting the fletches or vanes starts the arrow shaft to spinning. This spinning action is what causes the arrow shaft to stop bending back and forth, and strighten out, and travel more directly to the target.

Third; the more distance the arrow shaft has to travel, the more time it has to straighten out. Accuracy in archery depends greatly on in flight arrow shaft stablization, and stablization depends on spinning.

This invention is designed to start the arrow shaft spinning the moment the arrow nock leaves the bow string. This early spinning gyro action is the absolute basis of accuracy. When an arrow enters a target as if it were shot from some angle other than straight on the target, its due to being shot from very close range, and the arrow shaft has not stopped oscillating. The vaneless arrow shaft assists in solving the above problems.

BRIEF SUMMARY OF THE INVENTION

This invention has to do with the object of solving the problems of; Reducing damaged arrow shafts due to entering the target at odd angles. —Reducing wind resistance of arrows in flight. —Increasing arrow shaft penetation. —Increaseing arrow shaft speed. Eliminating broken nocks and vanes. —Increasing accuracy at close range, especially during hunting. —eliminating the cost of nocks, fletches, cements, and the cost of labor of assembly. —Less wind resistance, due to lack of arrow shaft oscillation. —Less wind resistance, due to not haveing standard arrow shaft vanes.

Presently, the major differences in arrow shaft technology is the vast number of materials and the number of vanes per arrow shaft. However, to date the vaneless arrow shaft is one of a kind. This invention can be made of a square twisted tubular construction, or a triangular spiraled tube. This invention is designed to start the arrow spinning (by mechanical means)even before the wind contacts the regular arrow shaft vanes.

DISCRIPTION OF DRAWINGS

DESCRIPTION OF INVENTION

A spinner tube, 10-with three molded spinner grooves 12-, and one bowstring nock 14-, are all a part of a one piece molded construction. A spinner groove-12-(three of) are made to correspond with three dimples-18-. After the spinner tube-10-has been inserted and positioned inside the arrow shaft body-22-, the final assembly is completed by pressing the dimples-18-into the arrow shaft body-22-. A bowstring nock -14-is designed to allow the bowstring to freely disengage without any restrictions. The bowstring nock is chamferred both vertically and horozonally (acompound angle). A nock recess-16-is to allow the user to grip firmer for this type of arrow shaft. The dimples -18-are the final step in completing the vaneless arrow shaft. The dimples are pressed into the arrow shaft body-22-, only after the spinner tube has been fitted and positioned inside the arrow shaft body-22-. The micro vanes-20-are molded into the arrow shaft body-22-and protude slightly above the surface of the body of the arrow shaft body-22-. They are positioned in location and at the approxmate same angle of where the standard arrow shaft vanes would go.

OPERATION OF THE INVENTION

Figure 1:
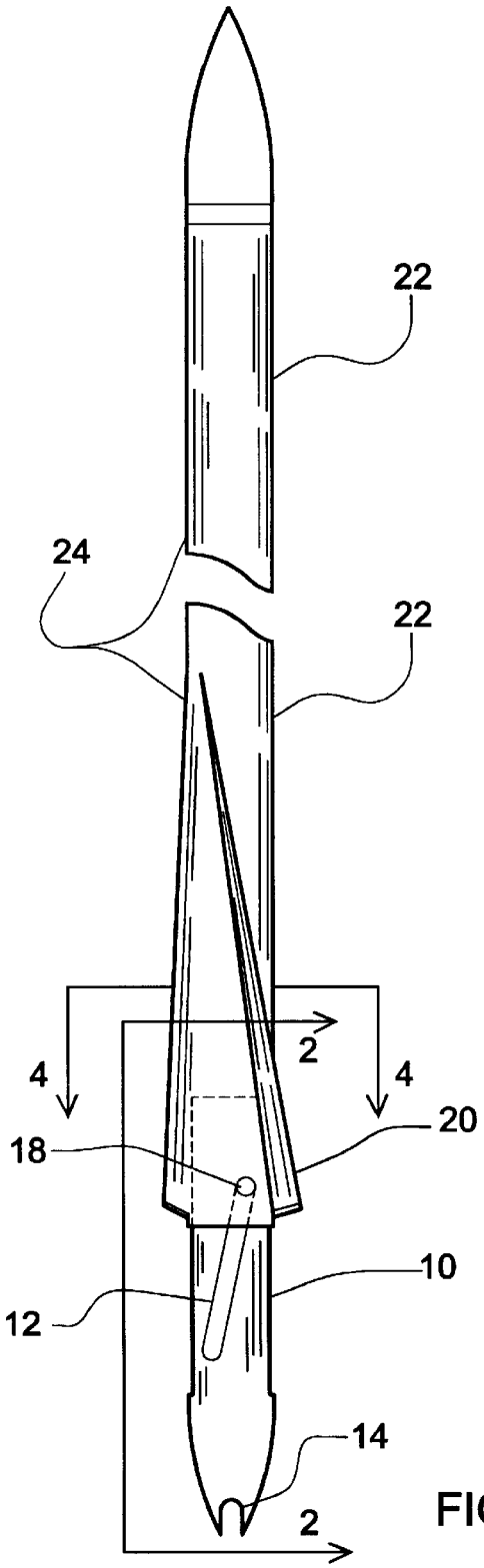
FIG. 1 is a plan view of a vaneless arrow shaft assembly, 24-and its verious components, 10-spinner tube, 12-spinner grooves, 14-bowstring nock, 18-dimples(3), 20-micro vanes, and 22-arrow shaft body.
Figure 4:
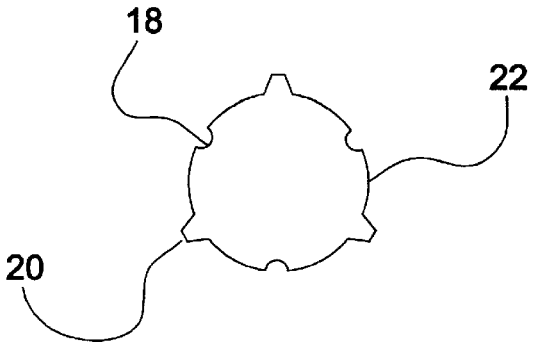
FIG. 4 shows an expanded end view along section line 4—4 in FIG. 1 of, 22-arrow shaft body, 18-dimples, and 20-mirco vanes.
Figure 3:
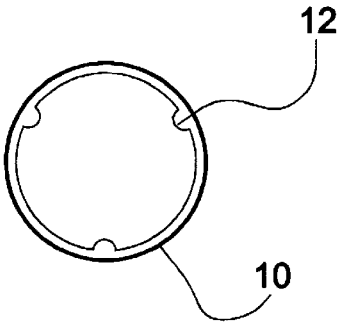
FIG. 3 is an expanded end view along section line 3—3 of fig two, 10-spinner tube, and 12 spinner grooves.
Figure 2:
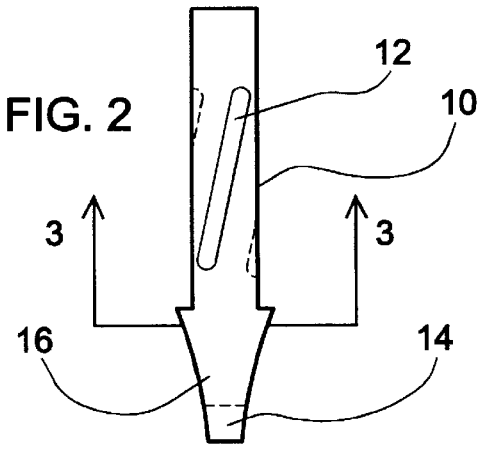
FIG. 2 is a side view along section line 2—2 in FIG. 1 of 10-spinner tube, 12-spinner grooves, 14-bowstring nock, 16-nock recess.

A perfered embobiment of the spinner tube-10-of this invention is shown in FIG. 1. The spinner grooves-12-of which there are three, start the arrow shaft spinning even before the wind starts to react. The invention comprises of only two moveing parts, the spinner tube-10-, and the arrow shaft body-22-. The spinner tube has molded into it three spinner grooves-12-. The assembly of the vaneless arrow shaft-24-, is as follows; The spinner tube-10-is placed inside the arrow shaft body-22-, where the three spinner grooves are aligned with the position of the three dimples-18-. To complete the final assembly operation, a backup tool is inserted in the tip end of the arrow shaft body and will go through into the spinner tube and fit tightely over the spinner grooves, so that when the dimples are pressed into the arrow shaft body-22-the pressure will not destort the arrow shaft body. This vaneless arrow shaft is now ready for use. When the vaneless arrow shaft-24-is nocked on a bowstring, by the user, and the bow is at a full draw. Upon release the spinner tube-10-is driven into the arrow shaft body-22-, and the following happens. The pressure of the bowstring pushes against the spinner grooves-12-, and the spinner grooves (which are at an angle) move against the dimples causing the whole arrow shaft to rotate immediately. This is an anti oscillation function. The bowstring nock-14 is also molded into the spinner tube-10-, the nock cutout is chamferred in two directions, vertically and horzonaly. Upon release, the bowstring will disengage freely to allow a smooth operation. The spinner grooves-12-have two indentations in each spinner groove. One at the front of each spinner groove and one in the rear of each spinner groove. These indentations are locks, they lock the spinner tube inside the arrow shaft body during flight, for better stabalazion and locks the spinner in the out position for launching. (these indentations are not shown). The spinner grooves, the dimples, and the microvanes are all spaced at 120° apart. The construction of the arrow shaft body-22-can be shaped and drawned with the mirco vanes-20-in the same operation. The spinner tube-10-can be molded on a hydropress or other simular michines. To use this invention is much the same as using or shooting a standard arrow shaft. With a differance performance from start to finish. Greater speed-more penetration-and entering the target straighter at close range. The purpose of the micro vanes-20-is to assist in stablizing the arrow shaft body-24-during long flights. The verious types of materials which may be used are; carbon fiber-graphite-magnesium-stainless steel-aluminum-fiberglass-and plastic.

I claim:

1. A vaneless arrow shaft combination comprising;

a hollow cylindrical arrow shaft body having a plurality of dimples circumferentially arranged along its interior surface;

a cylindrical spinner tube having a plurality of spiral grooves circumferentially arranged along its exterior surface, and a nock at its rear end to engage with the bowstring of a bow;

the spinner tube adapted to be inserted within the arrow shaft body;

the spiral grooves on the spinner tube adapted to engage with the dimples on the shaft boby when the spinner tube is inserted into the shaft body;

whereby when the bowstring is stretched and than released the engagement between the spiral grooves and the dimples impart rotation to the arrow shaft body.

2. The method of imparting spin to an arrow shaft comprising;

providing a hollow cylindrical arrow shaft body having a plurality of dimples circumferentially arranged along its interior surface;

providing a spinner tube having a plurality of spiral grooves circumferentially arranged along its exterior surface; and a nook at its rear end to engage with the bowstring of a bow;

inserting the spinner tube inside the hollow shaft body so that the spiral grooves on the exterior surface of the spinner tube engage with the dimples on the interior surface of the shaft body;

engaging the nook at the end of the spinner tube with the bowstring of a bow;

stretching and than releasing the bowstring to impart rotation to the shaft body via the engagement between the spiral grooves and the dimples.

* * * * *